US005287673A

United States Patent [19]

Kreikemeier

[11] Patent Number: 5,287,673

[45] Date of Patent: Feb. 22, 1994

[54] LATH FOR PLASTER AND THE LIKE

[76] Inventor: John E. Kreikemeier, 175 Ranchette Rd., Alpharetta, Ga. 30201

[21] Appl. No.: 831,947

[22] Filed: Feb. 6, 1992

[51] Int. Cl.[5] ..... E04C 2/42

[52] U.S. Cl. ..... 52/664; 52/663

[58] Field of Search ..... 52/664, 687, 361, 661, 52/663, 671, 675, 679, 681, 342, 414, 663, 664, 669

[56] References Cited

U.S. PATENT DOCUMENTS

| | | | |
|---|---|---|---|
| 3,145,001 | 8/1964 | Bruninga | 52/664 |
| 3,342,003 | 9/1967 | Frank | 52/664 |
| 4,168,924 | 9/1979 | Draper et al. | 404/70 |

*Primary Examiner*—Carl D. Friedman
*Assistant Examiner*—Beth A. Aubrey
*Attorney, Agent, or Firm*—Deveau, Colton & Marquis

[57] ABSTRACT

A lath for use in mounting plaster and the like to a substrate, the lath comprising a substantially planar, thermo-plastic grid including a plurality of first elongate, relatively flat strands extending laterally in a first direction and a plurality of second elongate strands extending laterally and transversely of the first elongate strands, the grid having a generally smooth side, and wherein the first elongate strands and the second elongate strands define a plurality of openings extending transversely through the grid, the second elongate strands comprising spacer portions positioned opposite the smooth side of the grid for spacing the grid a selected distance away from the substrate for allowing plaster to be introduced between the lath and the substrate without requiring the use of furring strips.

5 Claims, 2 Drawing Sheets

LATH FOR PLASTER AND THE LIKE

TECHNICAL FIELD

The present invention relates to the general field of building construction products, and more particularly relates to a lath for use in mounting plaster and the like to a substrate.

BACKGROUND OF THE INVENTION

In the application of plaster and the like to a vertical substrate, it is common in the art to place a metal lath against the substrate prior to applying any plaster. The lath is secured to the substrate, as by nailing, and acts to help stabilize the plaster while it is in its flowable state prior to drying and tends to reinforce the plaster.

FIG. 1 shows a typical prior art metal lath which is essentially a screen made up of individual undulating strands secured to each other in a heel-to-toe arrangement similar to overlapping shingles. One disadvantage of such a known metal lath is that, while the openings of the metal lath generally allow plaster to be passed therein to make direct contact with the underlying substrate, the lath generally remains in close contact with the underlying substrate and very little plaster becomes positioned between the lath structure and the underlying substrate. To ensure that at least a minimum amount of plaster is positioned between the metal lath and the substrate, it has been known in the art to first secure vertical furring strips of thin wood to the substrate prior to mounting the metal lath. This places the metal lath a selected small distance away from the substrate and ensures that plaster is forced between the metal lath and the substrate when the plaster is applied with a trowel. Of course, in many instances it would be desirable, if possible, to eliminate the need for first nailing furring strips to the substrate to prepare it for receiving a lath.

Another problem presented by the use of known metal laths in plaster is that the plaster is essentially alkaline and tends to corrode or attack the metal lath. The resulting corrosion of the metal lath can leach through the plaster causing stains in the exterior of the plaster, can reduce the mechanical strength of the lath itself, and can reduce the mechanical bond between the lath and the surrounding plaster. Also, known metal laths, such as that shown in FIG. 1, typically have a directional bias, that is, they are more well-suited for receiving plaster when applied with a trowel moving in one direction than with a trowel moving in some other direction. Obviously, it would be preferred that a lath be equally well-suited to receiving plaster when applied with a trowel moving in any direction.

Accordingly, it can be seen that a need yet remains for a lath for securing plaster to a substrate which allows plaster to be filled in between the lath and the substrate, while not requiring the use of furring strips nailed to the substrate, which is substantially chemically inert in the presence of the alkaline plaster, and which is well-suited for receiving plaster applied with a trowel moving in various directions. It is to the provision of such a lath that the present invention is primarily directed.

SUMMARY OF THE INVENTION

Briefly described, in a preferred form the present invention comprises a lath for use in mounting plaster and like materials to a substrate, the lath comprising a substantially planar grid. The grid includes first portions which extend laterally in a first direction and second portions which extend laterally and generally transversely of the first portions. The grid has a generally smooth side and the first portions and the second portions define a plurality of openings that extend transversely through the grid. The lath further comprises a plurality of spacer means positioned opposite the generally smooth side of the grid for spacing the grid away from the substrate for allowing plaster to be pressed between the grid and the substrate.

Preferably, the lath is made of a thermo-plastic material and therefore is substantially impervious to corrosion in the alkaline plaster. Also preferably, the first portions of the grid comprise a first plurality of relatively flat strands and the second portions of the grid and the spacer means together comprise a second plurality of strands which have a relatively flat portion and an upstanding portion attached to the relatively flat portion.

A lath constructed according to the present invention has the advantages of allowing plaster to be filled in between the grid and the substrate, while not requiring any furring strips to be mounted to the substrate first. Also, the thermo-plastic lath resists corrosion by the alkaline (basic) plaster and thereby retains its strength and mechanical bond over a long period of time and resists leaching of stains through the plaster from the lath. Finally, the generally smooth side of the grid allows plaster to be applied to the lath in any randomly selected direction with generally uniformly good results.

Accordingly, it is a primary object of the present invention to provide a lath for use in mounting plaster and the like to a substrate, which lath is durable in construction, economical in manufacture, and simple in use.

It is another object of the present invention to provide a lath for use in mounting plaster and the like to a substrate, which lath allows plaster to be filled in between a grid portion of the lath and the substrate.

It is a further object of the present invention to provide a lath for use in plaster and the like which lath resists corrosion when placed within the plaster.

It is yet a further object of the present invention to provide a lath for use in mounting plaster and the like to a substrate, which lath is well-suited to receiving plaster when applied from any direction with a trowel.

It is yet another object of the present invention to provide a lath for use in mounting plaster and the like to a substrate, which lath allows the plaster to be mounted to the substrate without requiring the use of thin furring strips to be mounted to the substrate first.

Other objects, features, and advantages of the present invention will become apparent upon reading the following specification in conjunction with the accompanying drawing figures.

BRIEF DESCRIPTION OF THE DRAWING FIGURES

DETAILED DESCRIPTION

Figure 4A:
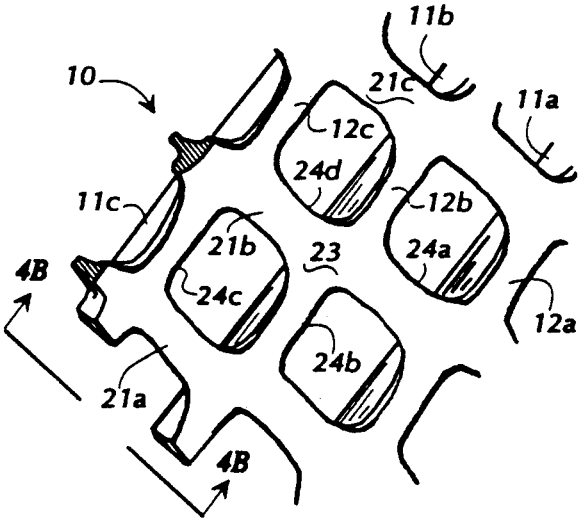
FIG. 4A is a perspective illustration of a lath according to a first preferred form of the invention.
Figure 4B:
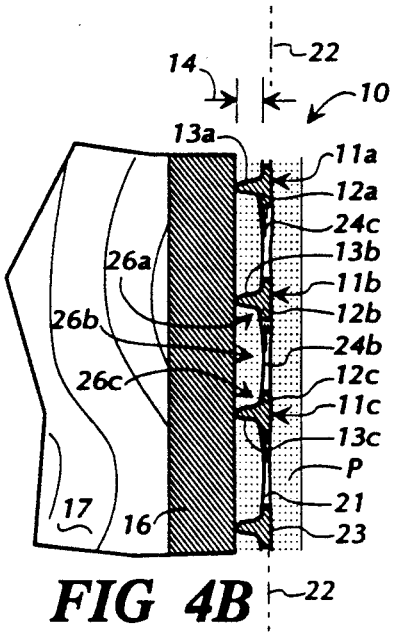
FIG. 4B is a sectional illustration of the lath of FIG. 4A taken along the lines 4B—4B, shown mounted adjacent a substrate and within plaster.

Referring now in detail to the drawing figures, wherein like reference numerals represent like parts throughout the several views, FIGS. 4A and 4B show a lath 10 in a preferred form of the present invention. The invention is intended for use in mounting plaster to a substrate, or for mounting similar flowable materials, such as for example joint compound used in drywall construction, grout underlayment, stucco, exterior insulated finish hardcoat systems ("EIFS") etc. The lath 10 depicted in FIGS. 4A and 4B preferably is made of a thermo-plastic material, such as polyethylene, polyvinylchloride (PVC), polyester, polystyrene, polypropolyene, with high density polyethylene being the most preferred based on current information. These materials have advantages of being easily and inexpensively fabricated and being resistant to corrosion in the alkaline environment of plaster. Also, these materials, when produced in sheets or rolls, are easily handled, manipulated and secured to the substrate.

As shown in the figures, the lath 10 includes a series of elongate strands 11*a*, 11*b*, 11*c* arranged in a generally planar configuration and extending laterally and parallel to one another. Typically, the lath would be produced in large sizes and the number of strands 11*a*, 11*b*, 11*c*, etc., would be considerable. However, for purposes of illustrating the invention, only a few such strands are shown in the figures to simplify the drawings. As shown in FIG. 4B, each of the strands 11*a*, 11*b*, 11*c*, is generally T-shaped and includes a flat portion 12*a*, 12*b*, 12*c*, which lies generally in the plane of the grid, to be discussed in more detail below. Also, each T-shaped strand 11*a*, 11*b*, 11*c* includes an upstanding portion or leg 13*a*, 13*b*, 13*c* extending generally perpendicular to the flat portions 12*a*, 12*b*, 12*c*. The upstanding leg portions 13*a*, 13*b*, 13*c*, etc., work to maintain at least a minimum spacing 14 between the flat portions 11*a*, 11*b*, 11*c* and the substrate 16 to which the lath 10 is mounted. As shown in FIG. 4B, typically the substrate 16 is secured by nailing to a wooden support beam 17.

A second series of strands extends laterally in the plane 22 of the grid, such as elongate strands 21*a*, 21*b*, 21*c*. Each of the second elongate strands 21*a*, 21*b*, 21*c* is relatively flat, as compared with the T-shaped strands 11. The flat strands 21*a*, 21*b*, 22*c*, etc., extend generally transversely of the T-shaped strands, with FIG. 4A showing that the strands 11 and the strands 21 are positioned perpendicular to one another to form a criss-cross grid pattern.

Together, the T-shaped strands 11 and the flat strands 21 define a criss-cross grid which is generally planar and is centered about plane 22. Also, the grid defines a generally smooth side surface 23. The T-shaped strands 11 and the flat strands 21 also cooperate to define openings in the grid, such as openings 24*a*, 24*b*, 24*c*, and 24*d*. The openings 24 allow plaster to be passed therethrough to contact the substrate 16 directly. Also, the plaster passing through the openings 24 becomes lodged under the grid between the grid and the substrate 16. Thus, the plaster can be positioned beneath the strands 11 and 21 to ensure a better bond of the plaster to the substrate and a better bond of the lath to the plaster.

Referring now more specifically to FIG. 4B, note in particular that, for example, plaster is forced beneath the grid in the region of regions 26*a*, 26*b*, and 26*c*. To this end, the upstanding legs 13 of the T-shaped strands 11 operate to allow plaster to get under the grid by spacing the grid at least a minimum distance away from the substrate. Preferably, this minimum distance should be at least 0.040 inches or great enough to allow the plaster to flow into the regions 26. Of course, this minimum distance may vary with flowable materials of different viscosities.

The lath according to the above description has the advantages of providing a superior bond between the lath and the plaster in that it allows plaster to be filled in behind the grid between the grid and the substrate. Also, the thermo-plastic material of the lath resists corrosion by the plaster which is alkaline (basic) in nature. This ensures that the lath retains its internal strength and its mechanical bond with the plaster over a long period of time and also resists leaching of stains through the plaster from the lath. Also, the smooth outer surface 23 of the lath allows easy application of plaster to the lath from any direction with uniformly good results.

Figure 1:
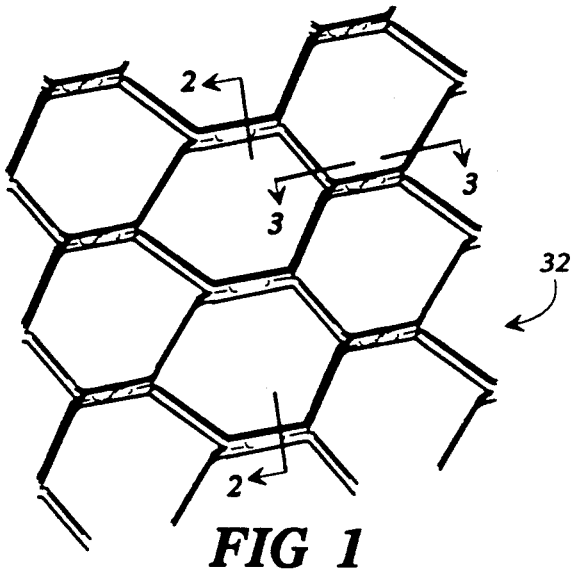
FIG 1 (PRIOR ART)
FIG. 1 is a perspective illustration of a prior art metal lath.

Some of these significant advantages of the prevent invention are best illustrated by considering the structure and performance of the prior art. For example, the metal lath shown in FIGS. 1–3 suffers from the disadvantage of not allowing substantial amounts of plaster to envelop the lath, and indeed, little plaster becomes lodged between the lath and the substrate 16. For example, in looking at FIG. 2, it can be seen that only very small regions, such as regions 31*a*, 31*b*, 31*c*, etc., are provided for receiving plaster P between the substrate 16 and the structure of the metal lath 32. Note also that each of the regions 31*a*, 31*b*, 31*c*, etc., tapers from a maximum height, which maximum height is slightly less than the thickness of one of the strands that make up the lath, to a minimum height equal to zero (0). Thus, the average height of the region is only one-half of the maximum height, which itself is less than the thickness of one strand. In a typical known metal lath, each strand has a thickness of approximately 0.040 inches or less. Thus, as viewed in FIG. 2, relatively small amounts of plaster can be positioned between the metal lath and the substrate, with much of the metal lath not becoming completed enveloped by plaster.

Figure 2:
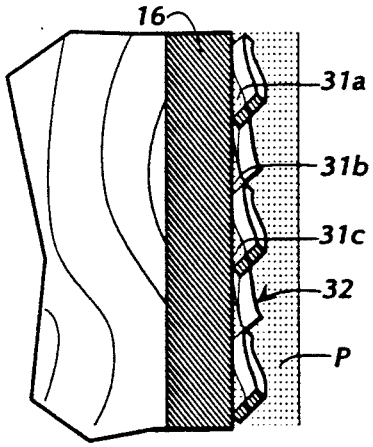
FIG 2 (PRIOR ART)
FIG. 2 is a side-sectional view of the prior art metal lath of FIG. 1 taken along the lines 2—2, shown mounted within plaster adjacent a substrate.
Figure 3:
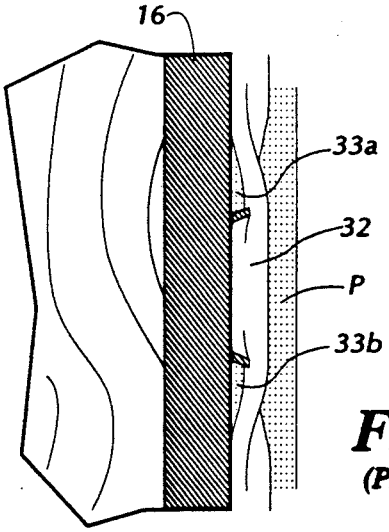
FIG 3 (PRIOR ART)
FIG. 3 is a top-sectional view of the prior art metal lath of FIG. 1 taken along the lines 3—3, shown mounted within plaster adjacent a substrate.

This general deficiency also is illustrated by considering FIG. 3 in which the same general concept of tapered regions, such as regions 33*a* and 33*b*, are positioned between the structure of the metal lath 32 and the substrate 16. However, in this view it can be seen that the regions 33 do not extend completely along the length of the structure, but rather are interspersed between those sections of the metal lath structure which directly contact the substrate 16. (For purposes of illustrating these differences, the scale of the metal lath as depicted in FIG. 2 and in FIG. 3 has been matched to that of the scale of the lath according to the present invention depicted in FIG. 4B).

FIG. 2 also illustrates the directionality of the metal lath 32 of the known prior art. Note that with the metal lath 32 positioned as shown in FIG. 2, the lath tends to help hold flowable plaster up because of the angled nature of the lath's structure. If the lath were turned upside down, the plaster would tend to run out when it was in the flowable state. Also, FIG. 2, and to a lesser extent FIG. 3, show that the outer surface of the metal lath 32 opposite the substrate 16 is not particularly flat or smooth. Indeed, it is generally undulated and requires some care in applying the plaster with a trowel to provide a smooth finish. In this regard, it also is important to move the trowel over the metal lath in a particular direction to avoid any "rippling" of the plaster due to the generally undulating surface of the metal lath. By comparison, the smooth outer surface 23 of the lath 10 according to the present invention allows for uniformly good results in applying plaster, generally irrespective of the direction of movement of the trowel.

An important advantage of the present invention is that the lath 10 can be nailed directly to the substrate 16, while still providing adequate spacing of the grid portion of the lath to allow plaster to be pressed between the grid and the substrate. In contrast to this, it has been common in the prior art to first nail furring strips to the substrate 16, and then to secure the metal lath 32 to the furring strips to leave a space or gap between the metal lath 32 and the substrate 16. The present invention eliminates the necessity of using furring strips. In this regard, the lath according to the present invention is "self-furring".

Figure 5A:
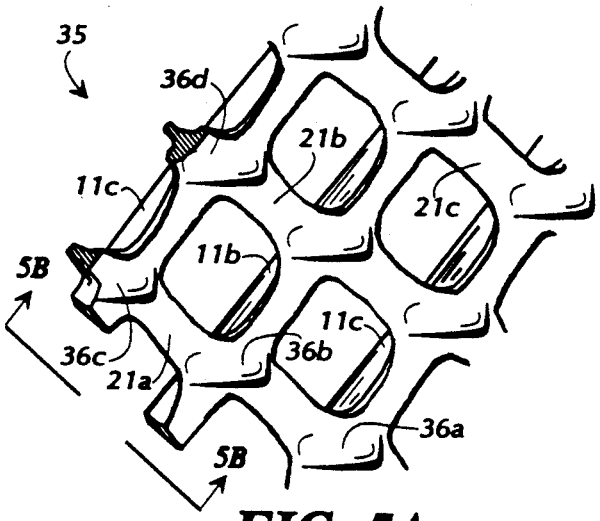
FIG. 5A is a perspective illustration of a lath according to a second preferred form of the invention.
Figure 5B:
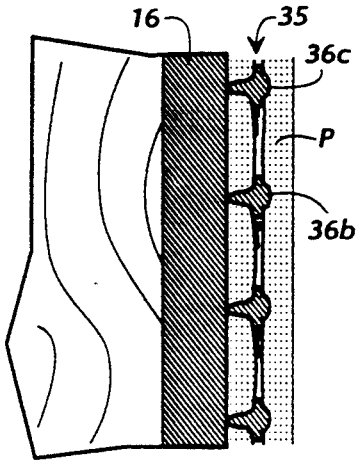
FIG. 5B is a sectional illustration of the lath of FIG. 5A taken along the lines 5B—5B, shown mounted adjacent a substrate and within plaster.

FIGS. 5A and FIG. 5B show a modified form of the present invention in which a lath 35 is constructed in much the same manner as that of FIGS. 4A and 4B, except that at the intersections of the T-shaped strands 11 and the flat strands 21, small slubs or bumps, such as slubs 36*a*, 36*b*, 36*c*, 36*d*, etc., are formed. This embodiment has a slight disadvantage of not being quite as smooth in its outer surface as compared with the embodiment of FIG. 4A and 4B.

Figure 6A:
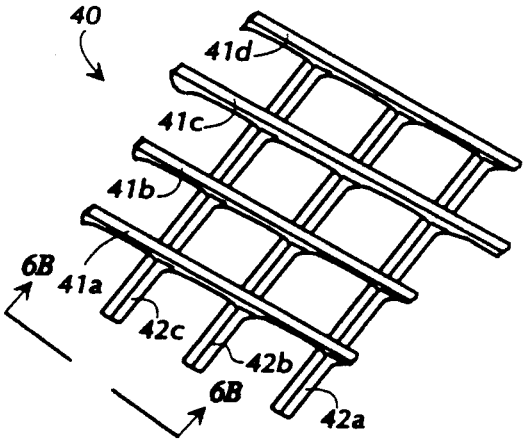
FIG. 6A is a perspective illustration of a lath according to a third preferred form of the invention.
Figure 6B:
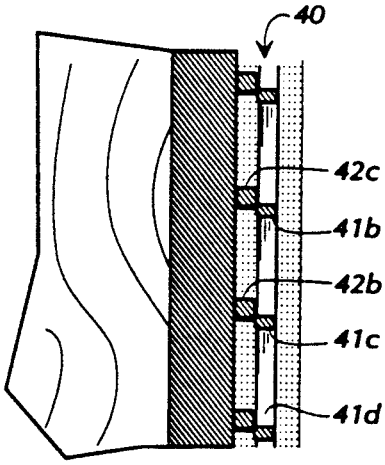
FIG. 6B is a sectional illustration of the lath of FIG. 6A taken along the lines 6B—6B, shown mounted adjacent a substrate and within plaster.

FIG. 6A shows yet a third embodiment, in which a lath 40 is made up of a criss-cross pattern of essentially rectangular, elongate strands, such as strands 41*a*, 41*b*, 41*c*, and 41*d*, and 42*a*, 42*b*, and 42*c*. The strands 42 are secured adjacent to strands 41. While this embodiment has many of the same features and advantages of those shown in FIGS. 4A–5B, the embodiment of FIGS. 6A and 6B suffers somewhat in that some care must be taken when applying the plaster with a trowel to move the trowel over the lath 40 generally parallel to the outer strands to avoid the "rippling" effect in the plaster.

Finally, while the embodiments shown and described herein disclose spacer means in the form of elongate ribs or legs, it is possible to use discrete stanchions or spikes, rather than the continuous spacers. Indeed, it is anticipated that the discrete arrangement will provide excellent results inasmuch as it allows even more plaster to be positioned between the grid and the substrate.

While the invention has been described in preferred forms only, it will be obvious to those skilled in the art that many modifications, additions, and deletions may be made therein without departing from the spirit and scope of the invention as set forth in the following claims.

I claim:

1. A wall or ceiling construction comprising:

a substrate;

a lath mounted to said substrate and comprising a substantially planar grid including first portions extending laterally in a first direction and second portions extending laterally and generally transversely of said first portions, said grid having a generally smooth side, and said first portions and said second portions defining a plurality of openings extending traversely through said grid, said lath further comprising a plurality of spacer means positioned opposite said generally smooth side of said grid for spacing said grid away from said substrate; and a surface treatment layer of plaster, stucco, or like material spread over and through said lath and in substantial contact with said substrate.

2. A wall or ceiling construction as claimed in claim 1 wherein said grid and said spacer means are made of a thermo-plastic material.

3. A wall or ceiling construction as claimed in claim 1 wherein said first portions comprise a first plurality of relatively flat strands and wherein said second portions and said spacer means comprise a second plurality of strands having a relatively flat portion and an upstanding portion attached to said relatively flat portion.

4. A wall or ceiling construction as claimed in claim 1 wherein said grid has a selected thickness and wherein said spacer means are sized and adapted to space said grid away from said substrate a distance generally at least as great as said selected thickness.

5. A wall or ceiling construction as claimed in claim 1 wherein said spacer means are sized and adapted to space said grid at least 0.050 inches away from the substrate.

* * * * *